US005172441A

United States Patent [19]

Mayen

[11] Patent Number: 5,172,441

[45] Date of Patent: Dec. 22, 1992

[54] WATER MATTRESS QUILTED TOP WITH STIFFENING INSERTS

[75] Inventor: Alfredo D. Mayen, Torrance, Calif.

[73] Assignee: Advanced Sleep Products, Carson, Calif.

[21] Appl. No.: 847,724

[22] Filed: Mar. 4, 1992

[51] Int. Cl.[5] ..... A47C 27/08; A47G 9/00

[52] U.S. Cl. ..... 5/500; 5/451; 5/460

[58] Field of Search ..... 5/451, 450, 460, 449, 5/482, 500, 502, 452, 422, 474, 917

[56] References Cited

U.S. PATENT DOCUMENTS 2,643,399 6/1953 Haeflinger ..... 5/460
3,728,747 4/1973 Docker ..... 5/460
4,057,862 11/1977 LaBianco ..... 5/451
4,187,566 2/1980 Peterson ..... 5/451

FOREIGN PATENT DOCUMENTS 2097665 11/1982 United Kingdom ..... 5/917

*Primary Examiner*—Alexander Grosz
*Attorney, Agent, or Firm*—Calfee, Halter & Griswold

[57] ABSTRACT

A quilted cover for a water mattress includes a peripheral side wall and a quilted top releasably attached thereto. The top has internal padding and a fabric outer surface. There is a peripheral recess in the top with the quilted fabric extending into the recess. Each side of the peripheral recess has a peripheral stiffening insert to prevent the recess from opening when a person sits or lies on the mattress.

7 Claims, 1 Drawing Sheet

WATER MATTRESS QUILTED TOP WITH STIFFENING INSERTS

THE FIELD OF THE INVENTION

This invention relates to water mattresses and particularly to the exterior covering for softsided water mattresses. The exterior quilted cover of a softsided mattress often has what is referred to as a "pillow top" which is removably attached by a zipper to the peripheral side of the cover. There is a peripheral recess in the top and often this recess tends to open when a person sits or lies down on the mattress. The present invention is directed to providing stiffening inserts on the sides of the peripheral recess to prevent it from opening.

SUMMARY OF THE INVENTION

The present invention relates to the cover for softsided waterbed mattresses and is particularly concerned with a stiffening insert to prevent opening of the edges of pillow top covers.

A primary purpose of the invention is the provision of stiffening inserts for the opposed sides of the peripheral recess in the quilted cover of a softsided waterbed mattress.

Another purpose is a pillow top waterbed mattress cover utilizing stiffening inserts on the opposed sides of the peripheral recess to prevent opening thereof.

Other purposes will appear in the ensuing specification, drawing and claims.

BRIEF DESCRIPTION OF THE INVENTION

The invention is illustrated diagrammatically in the attached partial vertical section through a waterbed mattress of the type disclosed herein.

DESCRIPTION OF THE PREFERRED EMBODIMENT

Figure 1:
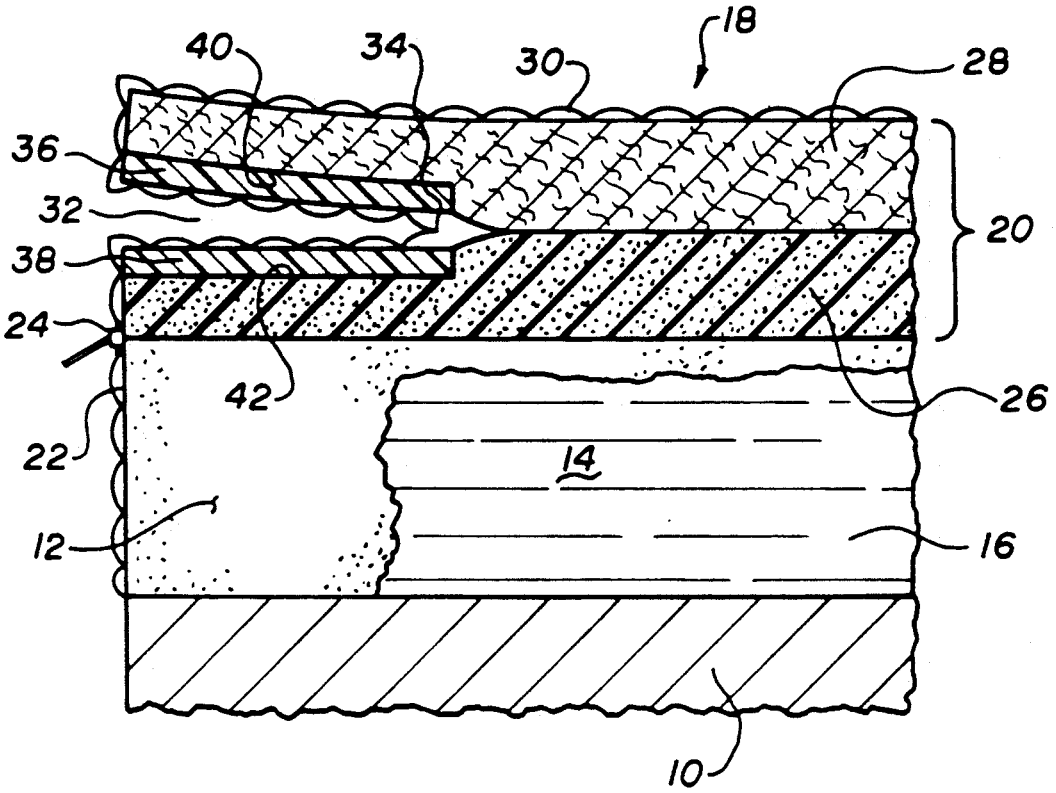

Conventional pillow top covers for softsided water mattresses have a peripheral recess with the quilted fabric on the top extending into the recess. When a person sits or lies down on such a mattress, particularly one which is not particularly firm, there is a tendency for the recess to open, which detracts from the appearance of the mattress, which is not desirable, particularly in a furniture showroom. The present invention overcomes the problem by providing stiffening inserts on the opposing sides of the recess.

In the drawing, which illustrates a portion of a softsided water mattress construction, a base or platform is indicated at 10 and a peripheral foam border is indicated at 12. The platform 10 and the border 12 define a cavity 14 within which is positioned a mattress shell or water bag 16. Conventionally, the shell 16 is made of polyvinylchloride and when filled with water may contain one of the many available types of hydraulic or fiber baffles to dampen wave action within the mattress.

The cover for the mattress is indicated generally at 18 and includes a top 20 and a peripheral side 22, with the top being attached to the side by a zipper 24. Both the top and the side in the preferred form include an exterior quilted fabric.

The construction of the top 20 may include a layer of foam or fiber indicated at 26 which is generally coextensive with the area of the cover and a top layer of quilted fiber indicated at 28 which again is coextensive with the area of the cover. The fabric 30, which extends over the cover 18 and is quilted as shown, extends into a peripheral recess 32 and is on both sides of the recess, with the quilted fabric being seamed as at 34. In order to prevent the recess 32 from opening when a person sits or lies on the mattress, there are peripheral stiffening inserts 36 and 38 which are positioned on opposite of the recess, inside of the quilted fabric and in small peripheral grooves 40 and 42, respectively, formed in the foam or fiber layers 26 and 28. Preferably, the stiffening inserts 36 and 38 are formed of polyethylene which is loaded with a filler so that the polyethylene is relatively rigid and heavy. Polyethylene normally has a density less than water, but when loaded with appropriate fillers, the density of the polyethylene is greater than one and will be relatively stiff to provide the desired resistance to opening of the recess when a person sits or lies on the mattress.

Although the invention describes polyethylene inserts on both sides of the recess, in some applications it may be sufficient if there is a polyethylene insert only on the upper side of the recess. What is important is to provide a degree of stiffness to the upper side of the recess so that it will not raise up when a person sits or lies on the mattress.

Whereas the preferred form of the invention has been shown and described herein, it should be realized that there may be many modifications, substitutions and alterations thereto.

The embodiments of the invention in which an exclusive property or privilege is claimed are defined as follows:

1. A quilted cover for a water mattress including a quilted top portion and a peripheral side portion releasably attached thereto, said top portion having a fabric outer surface and internal padding, a peripheral recess extending laterally into said top portion and defining two vertically spaced, horizontal sides that face each other, said outer surface fabric extending into said recess and covering peripheral stiffening inserts located proximated said sides, the covered peripheral stiffening inserts that define the sides of the recess being of sufficient size and rigidity to prevent the recess from opening when a person sits or lies on the mattress.

2. The cover of claim 1 further characterized in that said stiffening inserts are formed of polyethylene having a density greater than one.

3. The cover of claim 1 further characterized in that said stiffening inserts have a width generally coextensive with the depth of the recess.

4. The cover of claim 3 further characterized in that the outer surface fabric is quilted, with said quilting extending into said recess.

5. The cover of claim 1 further characterized in that said internal padding includes a layer of foam.

6. The cover of claim 1 further characterized in that said internal padding includes a layer of fiber.

7. The cover of claim 1 further characterized in that said peripheral stiffening inserts are generally equal in width.

* * * * *